United States Patent [19]

Langford

[11] Patent Number: 4,875,997

[45] Date of Patent: Oct. 24, 1989

[54] PROCESS FOR TREATING HYDROCARBONS CONTAINING MERCAPTANS

[75] Inventor: Virgil Langford, Great Falls, Mont.

[73] Assignee: Montana Refining Company, Black Eagle, Mont.

[21] Appl. No.: 272,614

[22] Filed: Nov. 17, 1988

[51] Int. Cl.[4] ..... C10G 19/02; C10G 19/08

[52] U.S. Cl. ..... 208/235; 208/189; 208/203; 208/208 R; 208/226; 208/227; 208/247; 423/183

[58] Field of Search ..... 208/189, 203, 226, 227, 208/235, 247, 284, 208 R; 423/183

[56] References Cited

U.S. PATENT DOCUMENTS

| | | | |
|---|---|---|---|
| 2,740,749 | 4/1956 | Meguerian et al. | 196/32 |
| 2,757,074 | 7/1956 | Grayson et al. | 423/183 |
| 2,853,432 | 9/1958 | Gleim et al. | 423/183 |
| 2,882,132 | 4/1959 | Nieuwenhuis et al. | 423/183 |
| 2,882,224 | 4/1959 | Gleim | 208/206 |
| 2,921,020 | 1/1960 | Urban | 208/205 |
| 2,988,500 | 6/1961 | Gleim | 208/206 |
| 3,098,033 | 7/1963 | Weisang et al. | 208/203 |
| 3,108,081 | 10/1963 | Gleim | 252/428 |
| 3,148,156 | 9/1964 | Henry | 252/420 |
| 3,409,543 | 11/1968 | Urban | 208/234 |
| 3,574,093 | 4/1971 | Strong | 208/206 |
| 3,758,404 | 9/1973 | Clonts | 208/263 |
| 3,923,645 | 12/1975 | Anderson | 208/206 |
| 4,069,138 | 1/1978 | Ward | 208/206 |
| 4,090,954 | 5/1978 | Ward | 423/183 |
| 4,104,155 | 8/1978 | Christman | 208/235 |
| 4,120,865 | 10/1978 | Ward | 208/206 |
| 4,243,551 | 1/1981 | Ward | 208/206 |
| 4,404,098 | 9/1983 | Asdigian | 208/235 |
| 4,412,912 | 11/1983 | Asdigian | 208/206 |
| 4,491,565 | 1/1985 | Verachtert | 422/256 |
| 4,562,300 | 12/1985 | La Foy | 208/235 |
| 4,626,341 | 12/1986 | Verachtert | 208/235 |
| 4,666,689 | 5/1987 | Maple et al. | 423/183 |
| 4,675,100 | 6/1987 | Maple et al. | 208/203 |

OTHER PUBLICATIONS

Sep. 1968 Edition of Hydrocarbon Processing, pg. 224.
Apr. 1982 Edition of Hydrocarbon Processing, pg. 124.

*Primary Examiner*—Helane Myers
*Attorney, Agent, or Firm*—Townsend and Townsend

[57] ABSTRACT

A process for treating hydrocarbons containing mercaptans comprising the steps of contacting a first mercaptan-containing hydrocarbon stream with a first aqueous alkaline solution stream to form a mercaptide-rich aqueous alkaline solution stream and a reduced-mercaptan hydrocarbon stream; combining said mercaptide-rich aqueous alkaline solution stream with a second mercaptan-containing hydrocarbon stream and with oxygen to form a first mixture; oxidizing said mixture to form a second mixture of hydrocarbon, disulfides and aqueous alkaline solution; and separating said second mixture into a disulfide-containing hydrocarbon stream and a regenerated aqueous alkaline solution stream; whereby said second hydrocarbon stream is sweetened and said mercaptide-rich aqueous alkaline solution is regenerated simultaneously in the same step.

36 Claims, 1 Drawing Sheet

PROCESS FOR TREATING HYDROCARBONS CONTAINING MERCAPTANS

BACKGROUND OF THE INVENTION

This invention relates to a process for treating liquid hydrocarbons which contain mercaptan compounds.

Mercaptans are malodorous organic sulfur compounds found in varying concentrations in liquid hydrocarbons. There are two basic methods for treating hydrocarbons containing mercaptans: (1) removal of the mercaptans from the hydrocarbon in a process known as extraction; or (2) neutralization of the mercaptans by conversion to disulfides in the hydrocarbon in a process known as sweetening.

In the extraction process, the mercaptan-rich hydrocarbon is combined with an aqueous alkaline solution, typically in a cross-flow vessel such as a vertical tray column. The mercaptans react with the caustic to form water-soluble mercaptides. The mercaptide/alkaline solution is typically regenerated in a separate vessel by oxidation in the presence of a catalyst to convert the mercaptides to disulfide oil. The disulfide oil is then separated from the alkaline solution, and the regenerated alkaline solution is recycled to the extraction vessel. U.S. Pat. No. 3,409,543 and U.S. Pat. No. 4,404,098, the disclosure of which are incorporated herein by reference, describe two such extraction processes.

In the sweetening process, the mercaptan-rich hydrocarbon is oxidized in the presence of a catalyst to convert the mercaptans to disulfides. The disulfides are soluble in the hydrocarbon and remain in solution with the final hydrocarbon product. Thus, while the sweetening process does not reduce the overall sulfur content of the hydrocarbon, it eliminates the offensive mercaptans. This process is therefore suitable for treating hydrocarbons in which some sulfur content is not objectionable. A sweetening process is described in U.S. Pat. No. 2,882,224, the disclosure of which is incorporated herein by reference.

A mercaptan treating process employing both methods is described in U.S. Pat. No. 3,574,093, the disclosure of which is incorporated herein by reference.

SUMMARY OF THE INVENTION

One drawback of the prior art mercaptan extraction processes is the need to dispose of disulfides. Disulfide disposal methods are often expensive. What is needed, therefore, is a process which minimizes or eliminates the need for disulfide disposal.

Another drawback of prior art mercaptan treating processes is the large capital investment in vessels, pipes and other equipment. What is needed, therefore, is a mercaptan treatment method which minimizes the number of vessels and pipes required.

A third drawback of the prior art mercaptan treating processes is disulfides which remain in the recycled alkaline solution after the separation step. These recycled disulfides diminish the effectiveness of the extraction process. What is needed, therefore, is a process which minimizes the sulfur content of the alkaline solution used in the extraction zone.

This invention meets these and other needs by providing a process which includes an oxidative sweetening step to simultaneously sweeten the hydrocarbon and regenerate the alkaline solution. The process treats two separate hydrocarbon streams to produce two different products: a low-sulfur hydrocarbon and a hydrocarbon containing sulfur in the form of disulfides.

In this process, the disulfide oxidation by-product remains in solution with the second hydrocarbon stream, thereby eliminating the need to dispose of the disulfides and lowering the disulfide concentration of the recycled alkaline solution. Furthermore, since the invention employs a single oxidation step for both sweetening and regeneration, the number of vessels and pipes is minimized. This simplified process therefore lowers the overall cost of the treatment facility.

Other advantages of the invention will be apparent from the description of the preferred embodiment.

DETAILED DESCRIPTION OF THE PREFERRED EMBODIMENT

Figure 1:
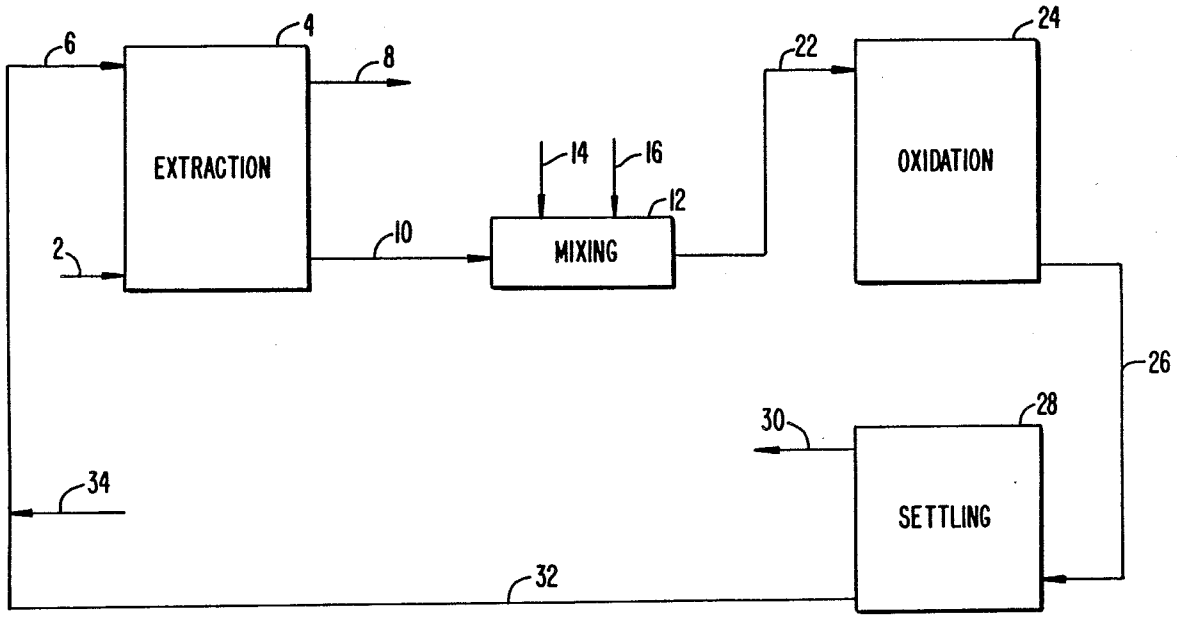
FIG. 1 is a schematic representation of the process according to the preferred embodiment of the invention.

The process according to the preferred embodiment of my invention will be described with reference to the drawing. The description omits subsystems such as pumps, valves, control systems, sensors and heaters for the sake of clarity. The placement and use of such subsystems will be apparent to those skilled in the art.

A hydrocarbon containing mercaptan is fed into an extraction zone 4 through an inlet 2. In the preferred embodiment, the hydrocarbon is a light straight run, such as naphtha, with a throughput of 1000 barrels per day.

An alkaline solution which is relatively mercaptan-free and disulfide-free is fed into extraction zone 4 through a second inlet 6. The alkaline solution reacts with the mercaptans to form mercaptides which are soluble in the alkaline solution. In the preferred embodiment, the alkaline reagent is an aqueous solution of an alkaline metal hydroxide, such as sodium hydroxide or potassium hydroxide, with a concentration range between 1.0 and 25.0 wt. %.

The volumetric flow ratio of alkaline solution to hydrocarbon may be between 0.01:1 and 1:1. This ratio varies according to the mercaptan content of the hydrocarbon being treated. In the preferred embodiment, the flow rate of alkaline solution is on the order of 5 gallons per minute.

Extraction zone 4 may contain one or more extraction vessels. In the preferred embodiment, the extraction vessel is a single vertical packed column. Another suitable extraction vessel is disclosed in U.S. Pat. No. 4,491,565, the disclosure of which is incorporated herein by reference. A vertically trayed column having a large number of circular perforations is yet another suitable extraction vessel. The extraction vessels preferably contain a packing material or other means to achieve adequate contact between the hydrocarbon and the aqueous solution, such as baffles, side to side pans, bubble trays, bubble decks, and the like. The extraction zone temperature varies between 10° C. and 121° C. and is preferably in the range of 27°–49° C. The pressure in the extraction zone may be between atmospheric pressure and 6895 kPag. In the preferred embodiment, the extraction vessel is operated at 50 psig and 80° F.

Extraction zone 4 transfers substantially all of the mercaptans from the hydrocarbon to the alkaline solution in the form of mercaptides and thereby lowers the overall sulfur content of the hydrocarbon. The treated hydrocarbon is removed from the process through line 8 for later use or sale.

The mercaptide-containing alkaline solution passes through line 10 to mixing zone 12. In the preferred embodiment, mixing zone 12 is an in-line static mixer. Oxygen is added to the alkaline stream in the mixing zone through line 14. The oxygen may be pure or may be mixed with other gases. Preferably, the total amount of gas added is limited to an amount which will be soluble in the liquids present in the mixing zone, thereby eliminating the need to vent excess gas.

A second hydrocarbon stream containing mercaptan is introduced to the mixing zone through line 16. In the preferred embodiment, the second hydrocarbon is JP4 and is added to mixing zone 12 at the rate of 1200 barrels per day. The mixture of hydrocarbon, alkaline solution and oxygen enters oxidation zone 24 through line 22.

The oxidation vessel contains a catalyst which converts the mercaptans in the hydrocarbon and the mercaptides in the alkaline solution into disulfides. The oxidation catalyst may be soluble in the alkaline solution, such as a metal phthalocyanine disulfonate compound in a concentration of between 5 and 1000 parts per million by weight. Alternatively, the catalysts may be placed on a highly absorptive, alkaline-resistant solid carrier material within the oxidation zone.

In the preferred embodiment, oxidation zone 24 is a vertical reactor having an activated charcoal bed. The preferred catalyst is FB Merox, available from UOP Inc. of Des Plaines, Ill. The reactor is operated at 60 psig and 95° F. Other suitable catalysts are disclosed in U.S. Pat. Nos. 2,853,432; 2,988,500; 3,108,081; 3,148,156; 3,409,543; 3,923,645; 4,069,138; 4,120,865; and 4,243,551, the disclosures of which are incorporated herein by reference.

After oxidation, the hydrocarbon/disulfide/alkaline mixture passes through line 26 to a settling zone 28. In the preferred embodiment, settling zone 28 is a void area in the bottom of oxidation zone 24. Alternatively, settling zone may be a separate vessel.

The disulfides are soluble in the hydrocarbon and relatively insoluble in the alkaline solution. The hydrocarbon and dissolved disulfides move to the top of the settling zone 28 and are removed through line 30 as treated product. The chemical equilibrium of the hydrocarbon/disulfide/alkaline mixture is such that the disulfide concentration of the alkaline solution at the bottom of the settling vessel is much lower than the disulfide concentration of the alkaline solution in prior art disulfide/alkaline separation subprocesses. The hydrocarbon and dissolved disulfides move to the top of the settling zone 28 and are removed through line 30 as treated product.

Essentially mercaptan-free and disulfide-free alkaline solution is drawn out of settling zone 28 through line 32. The alkaline passes through line 32 to line 6 to be used in extraction zone 4 as discussed above. Fresh alkaline solution may be added to line 6 through line 34 to maintain a predetermined solution strength.

This invention may be used to treat any hydrocarbon that is amenable to the extraction and sweetening processes. Preferably, the hydrocarbons treated by this process should have boiling points at or below 220° C., although hydrocarbons having boiling points as high as 345° C. may also be treated by this process.

The scope of this invention is not limited to the description of the preferred embodiment. Variations to the preferred embodiment will be readily apparent to those of ordinary skill in the art.

I claim:

1. A process for treating hydrocarbon streams containing mercaptans comprising the steps of:

(a) contacting a first mercaptan-containing hydrocarbon stream with a first aqueous alkaline solution stream to form a mercaptide-rich aqueous alkaline solution stream and a reduced-mercaptan hydrocarbon stream;

(b) combining said mercaptide-rich aqueous alkaline solution stream with a second mercaptan-containing hydrocarbon stream and with oxygen to form a first mixture;

(c) oxidizing said mixture to form a second mixture of hydrocarbon, disulfides and aqueous alkaline solution; and (d) separating said second mixture into a disulfide-containing hydrocarbon stream and a regenerated aqueous alkaline solution stream;

whereby said second hydrocarbon stream is sweetened and said mercaptide-rich aqueous alkaline solution is regenerated simultaneously in the same step.

2. The process of claim 1 further comprising the step of recycling said regenerated aqueous alkaline solution stream to supply said first aqueous alkaline solution stream.

3. The process of claim 1 further comprising the step of recycling a portion of said regenerated aqueous alkaline solution stream to supply said first aqueous alkaline solution stream.

4. The process of claim 3 wherein said first aqueous alkaline solution stream is further supplied by fresh aqueous alkaline solution.

5. The process of claim 1 wherein said oxidizing step further includes using an oxidation catalyst.

6. The process of claim 5 wherein said oxidation catalyst is soluble in the mercaptide-rich aqueous alkaline solution.

7. The process of claim 5 wherein said oxidation catalyst is supported on solid carrier material.

8. The process of claim 1 wherein the amount of oxygen added in said combining step is limited such that the amount of gas present in the oxidizing step will dissolve in said second mixture.

9. The process of claim 1 wherein said first aqueous alkaline solution stream comprises an aqueous solution of an alkaline metal hydroxide.

10. The process of claim 1 wherein said contacting step is performed in an extraction vessel.

11. The process of claim 10 wherein said extraction vessel comprises a vertical packed column.

12. The process of claim 1 wherein said combining step is performed in a mixer.

13. The process of claim 12 wherein said mixer comprises an in-line static mixer.

14. The process of claim 1 wherein said combining step and said oxidizing step are performed simultaneously.

15. The process of claim 1 wherein said said oxidizing step is performed in an oxidation vessel.

16. The process of claim 15 wherein said oxidation vessel is a vertical reactor having an activated charcoal bed.

17. The process of claim 15 wherein said separating step is performed in a portion of said oxidation vessel.

18. The process of claim 1 wherein said separating step is performed in a separation vessel.

19. A process for treating hydrocarbon streams containing mercaptans comprising the steps of:

(a) introducing a first mercaptan-containing hydrocarbon stream and a first aqueous alkaline solution stream into an extraction zone;

(b) contacting a first mercaptan-containing hydrocarbon stream with a first aqueous alkaline solution stream in said extraction zone to form a mercaptide-rich aqueous alkaline solution stream and a reduced-mercaptan hydrocarbon stream;

(c) removing said reduced-mercaptan hydrocarbon stream and said mercaptide-rich aqueous alkaline solution stream from said extraction zone;

(d) introducing said mercaptide-rich aqueous alkaline solution stream, a second mercaptan-containing hydrocarbon stream and oxygen into a mixing zone;

(e) combining said mercaptide-rich aqueous alkaline solution stream, said second mercaptan-containing hydrocarbon stream and said oxygen in said mixing zone to form a first mixture;

(f) introducing said first mixture into an oxidation zone;

(g) oxidizing said first mixture in said oxidation zone to form a second mixture of hydrocarbon, disulfides and aqueous alkaline solution;

(h) introducing said second mixture into a separation zone;

(i) separating said second mixture in said separation zone into a disulfide-containing hydrocarbon stream and a regenerated aqueous alkaline solution stream; and (j) removing said disulfide-containing hydrocarbon stream and said regenerated aqueous alkaline solution stream from said separation zone;

whereby said second hydrocarbon stream is sweetened and said mercaptide-rich aqueous alkaline solution is regenerated simultaneously in the same step.

20. The process of claim 19 further comprising the step of recycling said regenerated aqueous alkaline solution stream to supply said first aqueous alkaline solution stream.

21. The process of claim 19 further comprising the step of recycling a portion of said regenerated aqueous alkaline solution stream to supply said first aqueous alkaline solution stream.

22. The process of claim 21 wherein said first aqueous alkaline solution stream is further supplied by fresh aqueous alkaline solution.

23. The process of claim 19 wherein said oxidizing step further includes using an oxidation catalyst.

24. The process of claim 23 wherein said oxidation catalyst is soluble in the mercaptide-rich aqueous alkaline solution.

25. The process of claim 23 wherein said oxidation catalyst is supported on solid carrier material.

26. The process of claim 19 wherein the amount of oxygen introduced into said mixing zone is limited such that the amount of gas present in the mixing zone will dissolve in said second mixture.

27. The process of claim 19 wherein said first aqueous alkaline solution stream comprises an aqueous solution of an alkaline metal hydroxide.

28. The process of claim 19 wherein said extraction zone is within an extraction vessel.

29. The process of claim 28 wherein said extraction vessel comprises a vertical packed column.

30. The process of claim 19 wherein said mixing zone is within a mixer.

31. The process of claim 30 wherein said mixer comprises an in-line static mixer.

32. The process of claim 19 wherein said oxidation zone includes said mixing zone.

33. The process of claim 19 wherein said said oxidizing step is performed in an oxidation vessel.

34. The process of claim 33 wherein said oxidation vessel is a vertical reactor having an activated charcoal bed.

35. The process of claim 33 wherein said separating step is performed in a portion of said oxidation vessel.

36. The process of claim 19 wherein said separating step is performed in a separation vessel.

* * * * *